United States Patent [19]

McCarty

[11] 4,359,874

[45] Nov. 23, 1982

[54] REFRIGERATION SYSTEM MODULATING MEANS

[75] Inventor: William J. McCarty, Louisville, Ky.

[73] Assignee: General Electric Company, Louisville, Ky.

[21] Appl. No.: 243,410

[22] Filed: Mar. 13, 1981

[51] Int. Cl.[3] ..... F25B 5/00; F25B 41/06

[52] U.S. Cl. ..... 62/117; 62/119; 62/325; 62/511

[58] Field of Search ..... 62/325, 324.6, 511, 62/117, 119

[56] References Cited

U.S. PATENT DOCUMENTS

| | | | |
|---|---|---|---|
| 2,404,010 | 7/1946 | Urban . | |
| 2,453,131 | 11/1948 | Hubbard | 62/511 X |
| 2,670,011 | 2/1954 | Bertin et al. . | |
| 2,694,296 | 11/1954 | Prosek et al. | 62/511 |
| 2,746,266 | 5/1956 | Kosfeld | 62/511 |
| 2,896,422 | 7/1959 | Atchison | 62/197 |
| 3,642,030 | 2/1972 | Amick | 62/511 |
| 3,877,248 | 4/1975 | Honnold, Jr. | 62/511 |

*Primary Examiner*—Lloyd L. King

*Attorney, Agent, or Firm*—Frank P. Giacalone; Radford M. Reams

[57] ABSTRACT

A refrigeration system for use in an air valve heat pump including a modulating restriction means and method of controlling the level of liquid in the system condenser. The restriction means includes a pair of capillary tubes in series flow arrangement and a sonic restrictor connected at one end to the inlet of the downstream capillary tube and at its other end at a point on the condenser where refrigeration in liquid state is required.

4 Claims, 1 Drawing Figure

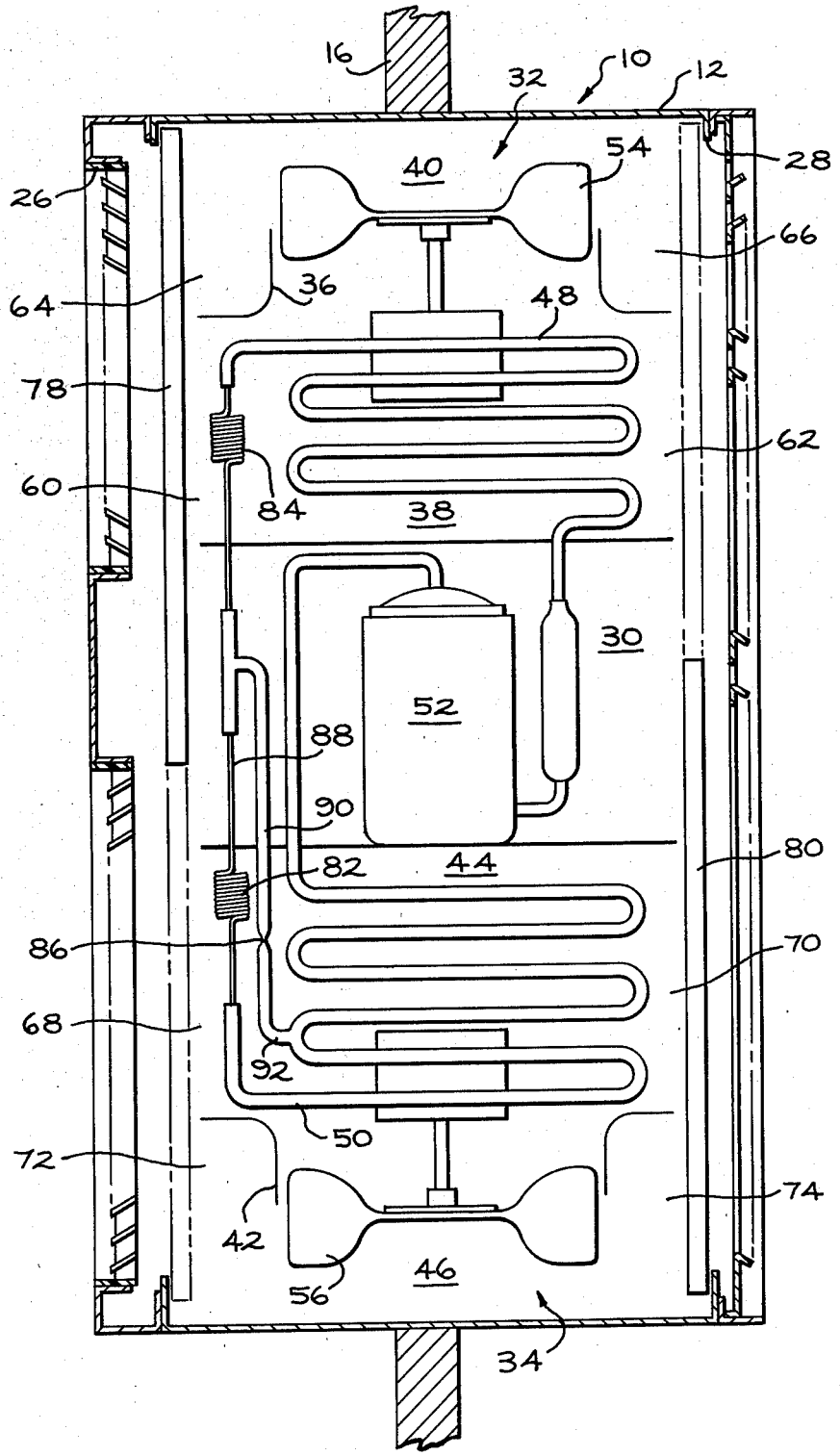
16
32
10
12
28
26
40
54
66
64
36
48
78
62
60
84
38
30
52
88
90
80
82
44
86
70
68
92
50
72
74
42
46
56
34

REFRIGERATION SYSTEM MODULATING MEANS

BACKGROUND OF THE INVENTION

Air valve heat pump refrigeration systems may be included in air conditioners so that air in the enclosure to be conditioned may be either heated or cooled for comfort. During the cooling operation, the air valves are positioned to cause indoor air to be circulated through the evaporator and outdoor air circulated through the condenser. Conversely, during the heating operation, the air valves cause indoor air to be circulated through the condenser and outdoor air circulated through the evaporator.

During the summer cooling operation or cycle, there is a considerable temperature differential between the evaporator and its surrounding atmosphere, the room air, whereas during the winter heating operation or cycle, there is ordinarily a much smaller differential between the evaporator and its surrounding atmosphere, the cold outside air. Thus, the evaporator subjected to outdoor temperatures and, in some instances, to frost accumulation during the heating cycle cannot pick up as much heat as is absorbed during the cooling cycle. As a result, the system cannot be operated with good efficiency at the same rate of refrigerant flow for both operations. A rate of refrigerant flow which allows substantially complete vaporization of refrigerant in the evaporator operating under indoor ambient during cooling results in a "flooding through" of the evaporator operating under outdoor ambient during the heating operation. In other words, with the most efficient rate of flow for the cooling cycle flowing during the heating cycle, the evaporator operating under outdoor ambient would be unable to vaporize all the refrigerant flowing therethrough so that liquid refrigerant would pass or "flood through" to the compressor.

In reverse cycle heat pumps, refrigerant flow is reversed through the system when changing from cooling to heating modes of operation.

By employing one way flow check valves and a capillary of different flow characteristics in parallel with each of the check valves one of the capillaries is bypassed depending on the direction of refrigerant flow. Accordingly only the capillary having the proper flow characteristics for the selected mode of operation monitors flow from the heat exchanger functioning as a condenser to the heat exchanger functioning as the evaporator.

In air valve heat pump systems the refrigerant flow is not reversed since air is selectively directed over the heat exchangers between the heating and cooling modes of operation. This means that the capillaries cannot be substituted as of function of the direction of refrigerant flow.

Accordingly, it is an object of the present invention to provide means for modulating restriction as needed to maintain a fixed level of liquid in the condenser.

SUMMARY OF THE INVENTION

It is therefore desirable that a refrigerator system having an expansion arrangement be provided in an air valve heat pump that provides a lower refrigerant flow rate when the evaporator is operating under outdoor ambient than when it is operating under indoor ambient.

Accordingly, it is an object of the present invention to provide an air valve heat pump refrigeration system utilizing capillary tube expansion means, in which a different rate of refrigerant flow is obtained during the heating than during the cooling cycle.

The present invention relates to a refrigerator system including an evaporator, a compressor, a condenser, and a restriction means for metering liquid refrigerant flow from the condenser and evaporator. The restriction means includes a first and second capillary tube arranged in series flow relationship between the condenser and evaporator. A conduit is connected at one end at the entrance to the second capillary and at its other end to the condenser at a point where a liquid level of refrigerant is required. The conduit serves to deliver a portion of refrigerant from the condenser to the second capillary. A sonic restrictor is arranged in the conduit for providing a controlled flow of refrigerant between the condenser and the second capillary. The sonic restrictor is dimensioned so that gaseous refrigerant when present in the sonic restrictor will cause a reduction in refrigerant flow to the second capillary until liquid refrigerant is present and flowing through the sonic restrictor.

BRIEF DESCRIPTION OF THE DRAWING

The single FIGURE is a schematic plan view showing an air valve heat pump incorporating the present invention.

DESCRIPTION OF THE PREFERRED EMBODIMENT

Referring to the drawing, there is shown an air conditioning unit 10 of the air valve or reverse air cycle type disclosed in U.S. Pat. No. 4,297,854-McCarty, issued Nov. 3, 1981 and assigned to the General Electric Company, the assignee of the present application, and said application is hereby incorporated by reference.

Air conditioning unit 10 includes a housing 12 that is adapted to be arranged in an opening in the wall 16 of an enclosure to be conditioned. The housing walls define generally a front opening 26 disposed on the enclosure side of wall 16 and a rear opening 28 disposed on the outdoor side of the wall 16. The housing is divided by a central machine chamber 30 to include an upper evaporator compartment 32 and a lower condenser compartment 34. A fan shroud 36 substantially divides the evaporator compartment 32 into an inlet area 38 and an outlet area 40. A fan shroud 42 substantially divides the condenser compartment 34 into an inlet area 44 and an outlet area 46. Mounted in the housing 12 is an evaporator 48 arranged in the inlet area 38 of compartment 40, a condenser 50 arranged in the inlet area 44 of compartment 34, and the compressor 52 arranged in the chamber 30. Air is circulated by a fan 54 in shroud 36 from the evaporator inlet area 38 to the outlet area 40 and similarly air is circulated by a fan 56 in shroud 42 from the condenser inlet area 44 to outlet area 46.

The inlet and outlet areas of the evaporator and condenser compartments are arranged with the housing 12 with each area having a pair of openings therein, one communicating with the opening 28 facing the outdoor, and a second opening communicating with the opening 26 facing the enclosure whereby air can be both introduced and discharged from the evaporator and condenser compartments in two different directions. More specifically, the evaporator inlet area 38 contains openings 60 and 62 and the outlet area 40 contains openings 64 and 66 in the indoor and outdoor side respectively of housing 12. Similarly, condenser compartment inlet area 44 is provided with openings 68 and 70 and the outlet area 46 is provided with openings 72 and 74 in the indoor and outdoor side respectively of housing 12.

A pair of dampers 78 and 80 are provided for controlling air flow through the compartments 32 and 34 which are arranged for vertical movement in openings 26 and 28 respectively. The dampers 78 and 80 are interconnected by suitable cables (not shown) to insure proper location of one damper over a compartment inlet and outlet on one side of the housing by movement of the damper arranged on the other side of the housing. The cable system interconnecting the indoor and outdoor dampers is fully explained in the U.S. Pat. No. 4,297,854.

In the heating mode, the dampers 78 and 80 are arranged in the position wherein air flow through the condenser chamber 34 is used to heat the air circulated from the enclosure. That is in the heating mode, the damper 78 closes the evaporator compartment inlet opening 60 and outlet opening 64 on the enclosure side opening 26 of housing 12 so that outdoor air is circulated through evaporator compartment 32 and, the damper 80 closes the condenser compartment inlet opening 70 and outlet opening 74 on the outdoor side opening 28 of housing 12 so that enclosure air is circulated through the condenser compartment 34 to warm the enclosure air recirculating there-through. In the cooling mode, the indoor damper 78 would be positioned over the enclosure side condenser inlet 68 and outlet 72 area opening, and the outdoor damper 80 would be positioned over the outdoor side evaporator inlet 62 and outlet 66 area opening so that outdoor air is circulated through the condenser chamber 34 and enclosure air is circulated through the evaporator chamber 40 to cool the enclosure air.

By the present invention, restriction means are provided for expanding the refrigerant from condensing pressure to evaporating pressure in a manner that results in an efficient refrigerant flow rate between condenser 50 and evaporator 48 both during the heating mode and during the cooling mode. More specifically, the restriction means is so arranged that there is more restriction to the flow of refrigerant during the heating mode than during the cooling mode whereby a lesser amount of refrigerant flows during the heating mode. In other words, if the evaporator is to be supplied with the proper amounts of refrigerant for maximum system performance during both the heating and cooling mode, some means must be provided for causing a lesser rate of flow to the evaporator during the heating mode than during the cooling mode. The restriction means in carrying out this controlled refrigerant flow for both the heating and cooling modes includes a pair of capillaries 82 and 84, and a sonic restrictor 86. This result of modulating the refrigerant flow is accomplished through the manner in which the capillary tubes and sonic restrictor are connected within the refrigeration system. The present arrangement not only obtains different restriction between heating and cooling mode as required, but actually varies the restriction during operation of the system in each mode as needed to maintain a fixed level of liquid refrigerant in the condenser.

Capillary tubes 82 and 84 are connected in series flow arrangement in the liquid line 88 leading from the condenser 50 to the evaporator 48. The capillary tubes are dimensioned so that the total restriction of the series arranged capillary tubes 82 and 84 is slightly greater than the restriction desired during the heating mode. The sonic restrictor 86, having an appropriately dimensioned opening, is arranged in a conduit 90 which is connected at one end to the liquid line intermediate the capillary tubes and more specifically to the entrance of capillary 84 and at its other end to the condenser at a point or tap 92 intermediate its ends. This point 92 may vary somewhat along the condenser according to the design of the system but it should be at the point where a liquid level of refrigerant is desired in the condenser. The actual construction of the sonic resistor 86 can vary, for example, it may be a separate part containing an appropriate opening that is placed in the conduit 90, or as in the present instance as shown, the sonic restrictor opening may be formed in the tube forming conduit 90. The size of the opening in the sonic restrictor can be determined by the following equation:

$$D = \sqrt{\frac{4Q}{\pi V_{hfg} d}}$$

D = diameter of sonic resistor
Q = capacity
V = sonic velocity
hfg = enthalpy of vaporization
d = density of fluid For example, for a heat pump rated at 12,000 BTU/hr., "D", for cooling would be 0.005 inch. Therefore, when liquid is backed up in the condenser to the take off point 92, the flow through the sonic restrictor would equal the desired high rate needed for cooling. The capillary 84 is sized to allow the desired flow with the remaining pressure potential available. In either the heating or cooling mode, if the capillary restriction is insufficient to back liquid refrigerant up in the condenser to point 92, then flow through the sonic restrictor 86 is drastically reduced. Sonic velocity of liquid refrigerant in approximately 5000 ft./sec. When conditions are such that bubbles of refrigerant gas form in the liquid at point 92, the sonic velocity of the refrigerant is reduced to approximately 100 ft./sec. This results in an approximate 50 to 1 change in flow rate through the sonic restrictor.

In effect, a modulating flow control means is provided by the present arrangement of capillary tubes 82 and 84, together with sonic restrictor 86 which maintains a desired liquid level in the condenser. Accordingly, the desired refrigerant flow rates for air valve heat pump are realized throughout the heating and cooling range by the sonic restrictor depending on the state of the refrigerant at point 92 of the condenser 50.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

I claim:

1. A refrigeration system operable in a heating and cooling mode including an evaporator, a compressor, a condenser, and restriction means for metering liquid refrigerant flow from said condenser to said evaporator said restriction means comprising:

a first and second capillary tube means in series flow relationship intermediate said condenser and evaporator;

a conduit connected at one end at the entrance to said second capillary and at its other end to a selected point in said condenser for directing a portion of refrigerant at said point to the entrance of said second capillary, said selected point in said condenser being in a position between its inlet and outlet where a liquid level of refrigerant is required;

a sonic resistor in said conduit for providing a controlled flow path for refrigerant from said selected point on said condenser to said entrance to said second capillary, said sonic restrictor being dimensioned so that gaseous refrigerant when present in said sonic restrictor will cause a reduction in refrigerant flow to said second capillary relative to when liquid refrigerant is flowing through said sonic restrictor.

2. A refrigeration system as recited in claim 1 wherein said sonic restrictor opening is dimensioned so that refrigerant flow between the condenser and evaporator is modulated in accordance to the state of refrigerant flowing therethrough so that refrigerant in liquid state is present at said selected point in said condenser.

3. A refrigeration system as recited in claim 2 wherein the first and second capillary tubes are dimensioned so that the total restruction therethrough in series is greater than the restriction required during the heating mode.

4. The method of modulating refrigerant flow between the system condenser and evaporator including the steps;

providing a first and second capillary tube means in series flow relationship intermediate said condenser and evaporator;

providing a conduit having one end connected to a selected point in said condenser where a liquid level of refrigerant is required and having its other end connected to the entrance to said evaporator;

locating a sonic restrictor in said conduit for providing a controlled flow path for refrigerant from said selected point on said condenser to said entrance to said second capillary;

dimensioning said sonic restrictor so that refrigerant flow between the condenser and evaporator is modulated in accordance to the state of refrigerant flowing therethrough so that refrigerant in liquid state is present at said selected point.

* * * * *

UNITED STATES PATENT AND TRADEMARK OFFICE

CERTIFICATE OF CORRECTION

PATENT NO. : 4,359,874

DATED : November 23, 1982

INVENTOR(S) : William J. McCarty

It is certified that error appears in the above—identified patent and that said Letters Patent is hereby corrected as shown below:

In the Claims:

Column 5, Claim 1, line 9, "resistor" should be --restrictor--.

Signed and Sealed this

*Eighth* Day of *February 1983*

[SEAL]

*Attest:*

GERALD J. MOSSINGHOFF

*Attesting Officer*

*Commissioner of Patents and Trademarks*